US006163755A

United States Patent [19]

Peer et al.

[11] Patent Number: 6,163,755

[45] Date of Patent: Dec. 19, 2000

[54] OBSTACLE DETECTION SYSTEM

[75] Inventors: Arik Peer, Moshav Kidron; Erez Sverdlov, Herzlia; Jacob Auerbach, Givat Savyon; Abraham Baum, Givataim, all of Israel

[73] Assignees: Thinkware Ltd., Tel-Aviv; Israel Aircraft Industries Ltd., Ben Gurion International Airport, both of Israel

[21] Appl. No.: 09/125,626

[22] PCT Filed: Feb. 27, 1997

[86] PCT No.: PCT/IL97/00076

§ 371 Date: Jun. 11, 1999

§ 102(e) Date: Jun. 11, 1999

[87] PCT Pub. No.: WO97/31810

PCT Pub. Date: Sep. 4, 1997

[30] Foreign Application Priority Data

Feb. 27, 1996 [IL] Israel ..... 117279

[51] Int. Cl.[7] ..... B61L 23/04

[52] U.S. Cl. ..... 701/301; 701/19; 340/436

[58] Field of Search ..... 701/301, 19, 28, 701/117; 340/901, 903, 937, 943, 435, 436; 246/170, 191, 182 R; 342/357, 455

[56] References Cited

U.S. PATENT DOCUMENTS

| | | | |
|---|---|---|---|
| 3,365,572 | 1/1968 | Strauss | 246/167 |
| 4,578,665 | 3/1986 | Yang | 246/166 |
| 5,301,115 | 4/1994 | Nouso | 701/300 |
| 5,424,952 | 6/1995 | Asayama | 701/200 |
| 5,429,329 | 7/1995 | Wallace et al. | 246/166 |
| 5,448,484 | 9/1995 | Bullock et al. | 701/117 |
| 5,486,819 | 1/1996 | Horie | 340/905 |
| 5,487,116 | 1/1996 | Nakano et al. | 382/104 |
| 5,493,499 | 2/1996 | Theurer et al. | 701/207 |
| 5,574,469 | 11/1996 | Hsu | 342/455 |

FOREIGN PATENT DOCUMENTS

| | | |
|---|---|---|
| 0 586 857 | 3/1994 | European Pat. Off. . |
| 2 586 391 | 2/1987 | France . |
| 26 31 654 | 12/1977 | Germany . |
| 195 05 487 | 9/1995 | Germany . |

OTHER PUBLICATIONS

Patent Abstracts of Japan, App. No. 04–266,567, published Sep. 22, 1992.

Patent Abstracts of Japan, App. No. 05–116,626, published May 14, 1993.

Patent Abstracts of Japan, App. No. 59–156,089, published Sep. 5, 1984.

*Primary Examiner*—Tan Nguyen

*Attorney, Agent, or Firm*—Browdy and Neimark

[57] ABSTRACT

A system for alerting a driver of a vehicle of the presence of an obstacle in a track of the vehicle, comprising a sensor mounted on the vehicle for producing at least one sensor signal representative of a predetermined field of view of the track in front of the vehicle, and an obstacle detection device coupled to the sensor for processing the at least one sensor signal produced thereby so as to detect an obstacle in the track and produce an obstacle detect signal consequent thereto. An obstacle avoidance device is mounted in the vehicle and coupled to the obstacle detection device and is responsive to the obstacle detect signal for producing an obstacle avoidance signal. According to a preferred embodiment, the track is a rail track, the vehicle is a railway engine and the sensor includes a video camera for imaging the track. The resulting image is processed so as to detect a potential obstacle on the tracks allowing the brakes to be applied either manually or automatically.

56 Claims, 3 Drawing Sheets

OBSTACLE DETECTION SYSTEM

FIELD OF THE INVENTION

The present invention relates generally to an obstacle detection system and in particular to a railway anti-collision system. Within the context of the present invention, as well as in the claims, the term "obstacle" is intended to embrace any obstacle on the tracks, including another train, or a break in one or both of the track's rails which, if not compensated for, would cause damage and impair a train's progress.

BACKGROUND OF THE INVENTION

Railway infrastructure is expensive both in terms of rolling stock and track. Although generally regarded as one of the safest forms of transport, railway accidents are common and frequently fatal. Of the most dangerous of such accidents are collisions between trains or between trains and vehicles crossing the track in the path of an oncoming train; and derailments consequent to foreign objects placed either willfully or accidentally on the line. Such objects may or may not be seen by the engine driver prior to collision therewith, especially at night. Under these circumstances, the best that can usually be achieved is to reduce the collision speed. As statistics of rail accidents demonstrate only too well, mere reduction of collision speed might significantly reduce the damage, even if the train is not able to get to a complete standstill. Bearing in mind the trend to increase the speed of rolling stock with the consequent increase in stopping distance, the drawbacks of existing approaches and the rising costs of insurance claims and premiums are likely to become even more severe.

The prior art disclose various approaches to preventing or signalling potential collisions between rolling railstock. For example, in U.S. Pat. No. 3,365,572 (Strauss) a modulated laser beam is directed from opposite ends of railstock so that the corresponding laser beams transmitted from two approaching trains may be detected by the other train, allowing remedial action to be taken. Likewise, image processing techniques are known both for vehicle recognition as in U.S. Pat. No. 5,487,116 (Nakano et al.) and for detecting a vehicle path along which a vehicle is travelling as in U.S. Pat. No. 5,301,115 (Nouso). Further, the use of Global Positioning Systems (GPS) on railstock has been proposed in U.S. Pat. No. 5,574,469 (Hsu) for improving the collision avoidance between two locomotives.

Existing systems are known which exploit the flow of current through one rail and its return through the other rail in order to detect an electrically conductive object placed on the track thereby shorting the rails. However, such systems are practical only for electrical railway systems having two tracks for providing live and return paths for the electric current. Specifically, they are not suitable for railway systems employing overhead power lines; nor for those systems which employ a third rail either mid-way between the regular rail or alongside one of the rails. Moreover, they are unsuitable for detecting non-conductive obstacles on the track. Yet a further drawback of such known systems is that they are static.

Also known is an obstacle detection system for monitoring a railroad track far ahead of a train so as to warn against stationary or moving obstacles. The system comprises a transceiver mounted on the train and a number of relays deployed along the railroad track. The moving train emits a laser beam which is picked up by one of the relays along the track and coupled into a fiberoptic cable which thus relays the laser signal along a long distance of track ahead of the train. The fiberoptic cable is coupled to an exit port for directing the laser beam towards a retroreflector disposed diagonally across the tracks such that an obstacle placed on the track ahead of the moving train obstructs the laser beam. The retroreflected laser beam retraces its path along the fiberoptic cable back to the train allowing an on-board processor to determine the presence of the obstacle in sufficient time to enable corrective action to be taken. Such a system enables detection of an obstacle which is far ahead of the train and out of direct sight thereof However, it requires expensive infrastructure and maintenance.

Systems are also known containing a database wherein there is stored data representative of a complete length of track. During operation, each imaged section is compared with the corresponding section of track in the database in order to infer therefrom whether the track image corresponds to the database or not; the inference being that any mismatch is due to an obstacle on the imaged section of the track.

Such an approach is hardly feasible for mass transit systems based on perhaps hundreds of kilometers of track (if not more). It is clear that to store a database of a complete image of a track stretching across a route of many hundreds of kilometers would require a memory capacity rendering such an approach hardly practicable. Thus, such approaches have, in the past, been confined to relatively short lengths of track such as may be found, for example, in factories, shipyards and the like.

Such an approach is disclosed for example in JP 59 156089 which requires a large capacity memory in which there is stored a photographed image of the route which is to be traveled by the vehicle. A video comparator compares each instantaneous image of the track with a corresponding image in the storage device so as to interpret any mismatch as an obstacle on the tracks. Such an approach is subject to the various drawbacks highlighted above as well as requiring that the actual location of each imaged section of the tracks be known. Otherwise, it is not possible to compare the database image with the instantaneous image of the track section obtained during motion of the vehicle. This, in turn, requires synchronization between the "rolling" image of the track during motion of the vehicle and the track image stored in the database.

Typically, such synchronization is effected from a knowledge of the speed of the vehicle and elapsed time which can be translated into distance traveled so that from an initial starting point (time=zero) the actual distance traveled by the vehicle can be determined. This, in turn, allows determination as to which stored section of track in the database must be compared with the instantaneous image for the purpose of obstacle detection.

JP 05 116626 discloses an obstacle detection system for use with rolling stock wherein an infrared camera is mounted on an engine in conjunction with an image-processing means for determining whether an obstacle is present on the rails. Here again however, the algorithm is based on the use of a pre-stored database of the complete track such that each imaged frame is compared with the pre-stored database so as to construe any discrepancy as an obstacle.

As noted above, with reference to cited JP 59 156089, this requires a very high volume memory which renders such a system virtually impractical for mass-transit systems covering large distances; and further requires synchronization.

One of the problems associated with obstacle detection systems for track-led vehicles is the fact that it is obviously necessary to provide advanced warning of an obstacle in sufficient time to allow the vehicle to break to a complete standstill. Unless this is done, then the vehicle will still collide with the obstacle albeit possibly at reduced speed. One approach to this problem is suggested in U.S. Pat. No. 5,429,329 and FR 2 586 391 both of which teach the use of a robotic vehicle which travels in front of a train so as to image a section of the track and relay information to the engine driver so as to provide advance warning of an obstacle on the track ahead of the engine. The use of auxiliary vehicles which are sent in advance of a railway engine, for example, allows local imaging of a section of track well in advance of the engine although it introduces other technical problems such as relaying the information back to the engine.

Another, quite different approach, is to mount the imaging camera on the engine itself, although this approach is subject to the problem of remotely imaging a section of track several kilometers ahead in order to allowing for the stopping distance of the locomotive when travelling at high speeds. It is to be noted that these two approaches, namely: (a) use of a robotically-controlled auxiliary vehicle which effects local imaging of a section of a track remote from the engine but directly in front of the auxiliary vehicle; and (b) remote imaging of a section of track which may be several kilometers from the engine; represent fundamentally different solutions to the same problem. It is clear that when a robotically-controlled auxiliary vehicle is employed, a relatively unsophisticated imaging system can be employed since the quality thereof is unlikely to be adversely affected by ambient conditions, such as weather and so on. On the other hand, when the imaging system is mounted on the track-led vehicle itself and is intended to image a section of track relatively remote therefrom, ambient conditions such as cloud, fog and so on can render the imaging system useless.

For the sake of a complete discussion of prior art, reference is also made to JP 04 266567 which relies on relaying to an engine driver a photo-reduced image of a section of track (e.g. railroad crossing). The compressed data is expanded so as to reproduce the original image which is then displayed on a monitor inside the engine so as to be visible to the driver. There is no automatic processing of the data in order to determine the presence or absence of an obstacle on the track. Rather, the required discrimination is performed manually by the driver.

It would obviously be preferable to employ a detection system which is mobile and detects any type of object on the railway track.

SUMMARY OF THE INVENTION

It is a particular object of the invention to provide a system for providing an advanced warning of the presence of an obstacle or another train on a section of rail track, or of partial absence of rail, thus permitting suitable remedial action to be taken so as to avoid an engine colliding with the obstacle.

According to a broad aspect of the invention, there is provided a system for alerting a controller of a track-led vehicle of the presence of an obstacle in a track of said vehicle, the system comprising:

sensor means mounted on the vehicle for sensing a predetermined field of view of the track in front of the vehicle so as to produce at least one sensor signal representative of a section of track ahead of the vehicle, an obstacle detection device coupled to the sensor means for processing the at least one sensor signal produced thereby so as to detect a discontinuity in the track and produce an obstacle detect signal consequent thereto, and an obstacle avoidance means mounted in the vehicle and coupled to the obstacle detection device and being responsive to the obstacle detect signal for producing an obstacle avoidance signal.

When used for detecting obstacles on a section of railway track, the sensor is mounted on the engine and the track defines the path of the train. An obstacle detection algorithm is employed in which a first stage allows for a section of track ahead of the engine to be analyzed so as to detect the location of the rails therein whereupon a second stage is initiated for detecting an obstacle placed on the rails.

The first stage of the algorithm may also be used independent of the second stage for automatically guiding a vehicle along a path defined by a visible (or otherwise detectable) line.

Preferably, in the case of non-automatic trains wherein the controller is a driver of the vehicle, the track is imaged by a video camera mounted on the engine and the resulting image is processed so as to detect an obstacle on the rail or a broken rail. The image is relayed to the driver who sees the track in close-up on a suitable video monitor. The obstacle avoidance means is an alarm which advises the driver of an impending collision. The ultimate decision as to whether an artifact on the track constitutes a real danger rests with the driver, who is free to take remedial action or ignore the warning as he sees fit. In automatic trains having no driver in them, the ultimate decision as to whether to take remedial action is made by the system in accordance wit pre-defined criteria and the obstacle avoidance means applies the brakes automatically. To this end, the relevant data is transmitted to, and processed by a monitoring and control center in real time in order to decide whether or not to apply the brakes, in which case a suitable brake control signal is relayed to the train.

Such a system allows the engine driver to see possible obstacles on the track clearly, both during the day and at night, in sufficient time to take complete remedial action so as to prevent collision of the rolling stock and/or avoid possible derailment, or at least significantly reduce the train's speed prior to a collision or derailment. In order to see the obstacle at night, there may be employed a Forward Looking Infrared (FLIR) camera or an ICCD video camera. Alternatively, a normal video camera may be employed in combination with active illumination. In order to overcome the problem of poor visibility which may arise in adverse weather conditions, advanced thermal imaging techniques may be employed. Likewise, radar such as, for example, Phase Array Radar may be used in addition to an electro-optical imaging system for improving the detection of obstacles in adverse weather conditions. In this case, owing to the relatively low resolution of radar, reflectors are placed between or alongside the rails so that if there be no obstruction on the rails, the radar will detect the reflectors. On the other hand, an obstacle may be assumed to hide the reflectors from the radar thus preventing their detection. Typically, the reflectors are comer reflectors having the form of an inverted L which are deployed alongside the rails without obstructing the rails enabling the radar to detect the track. The radar beam is typically cued towards the rails at a distance of 1 Km although lesser distances may also be monitored. The spacing between adjacent reflectors is adapted according to the track's features. Thus, in totally flat terrain, a spacing of several hundred meters between adjacent reflectors is sufficient; but this spacing must be reduced for less ideal conditions.

BRIEF DESCRIPTION OF THE DRAWINGS

In order to understand the invention and to see how it may be carried out in practice, a preferred embodiment will now be described, by way of non-limiting example only, of a system for alerting an engine driver of an obstacle on the track and with reference to the accompanying drawings, in which.

DETAILED DESCRIPTION OF A PREFERRED EMBODIMENTS

Figure 1A:
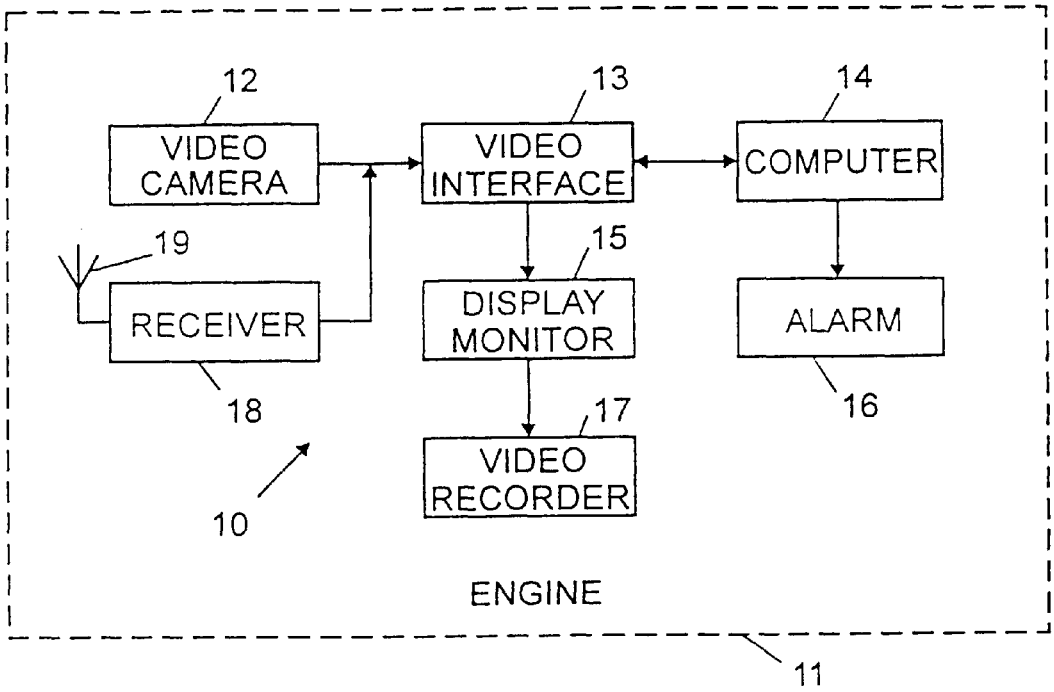
FIG. 1*a* is block diagram showing functionally the principal components of a system according to the invention.

FIG. 1*a* shows functionally a system 10 for mounting on a railway engine 11 and comprising a video camera 12 (constituting a sensor means) which is mounted on gimbals so as to be automatically directed to a railway track (not shown) and produces a video image of a section of rail track within its field of view. The resulting video image fed via a video interface 13 to a computer 14 (constituting an obstacle detection means) which is programmed to process successive frames of video data so as to determine a discontinuity in one or both of the rails, suggestive of an obstacle disposed thereon or of a break in the track, and to produce a corresponding obstacle detect signal. A display monitor 15 coupled to the video interface 13 permits the engine driver to see the track imaged by the video camera-12, whilst the video interface 13 automatically points the video camera 12 to the continuation of the rail and provides the engine driver with an enlarged instantaneous image of selected features, as well as changing contrast and other features thereof. An audible or visual alarm 16 is coupled to the computer 14 and is responsive to the obstacle detect signal produced thereby so as to provide an immediate warning to the engine driver of the suspected presence of an obstacle on the track or of a break in the track.

A video recorder 17 is coupled to an output of the display 15 for storing the video image on tape so as to provide a permanent record of the track imaged by the video camera 12. This is useful for analysis and post mortem in the event of a collision or derailment.

In order to ensure that the video camera 12 correctly follows the track, the video image is processed in order to determine apparent movement of the tracks which is then compensated for by automatically adjusting the orientation of the video camera 12. Each frame of the video camera 12 shares a large area with a preceding frame. The two frames are compared in order to determine those areas which are common to both frames. From this, that part of the subsequent frame corresponding to the continuation of the rails from the situation represented by the preceding frame may be derived. This is done using a pattern recognition algorithm, for example by using a library of pictures of rails and matching any of them to two parallel lines in the frame. Such algorithms are sufficiently robust to allow for slight disturbances between successive frames without generating false alarms. As a result of this analysis, it is possible to identify the point in the preceding frame where the subsequent frame commences. This in turn permits the continuation of the subsequent frame to be derived allowing the direction of the far end of thereof relative to start thereof to be computed. At the start of the cycle, the video camera 12 is directed to the start of the subsequent frame, corresponding to the end of the preceding frame. It may now be directed to the end of the subsequent frame and the whole cycle repeated.

There may be occasions when an obstacle on the tracks is obscured from the video camera 12 owing to sharp bends in the track, for example, such that by the time the obstacle is within the field of view of the video camera 12, it is already too late to take remedial action. To avoid this, there may also be provided within the system 10 a receiver 18 for receiving an externally transmitted video image via an antenna 19.

Figure 1B:
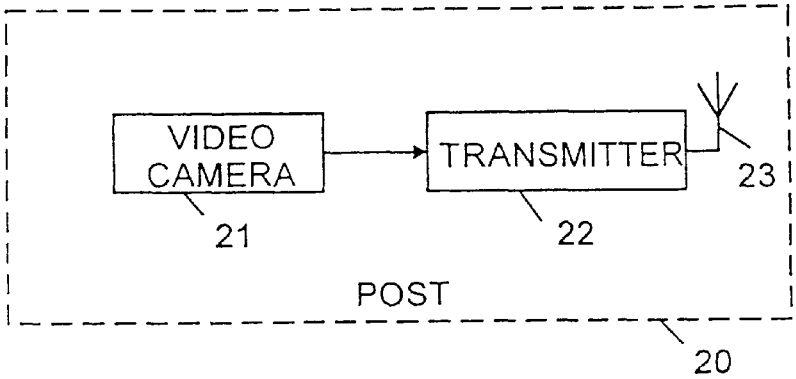
FIG. 1*b* is block diagram showing functionally an external post having mounted thereon auxiliary components of an enhanced system according to the invention.

FIG. 1*b* shows a post or tower 20 mounted near a sharp bend in the track, or near any section of track where visibility is impaired for any other reason, and having mounted thereon an auxiliary video camera 21 for producing an auxiliary video image thereof. A transmitter 22 is coupled to the auxiliary video camera 21 for transmitting the auxiliary video image via an antenna 23 to the receiver 18 within the system 10. The auxiliary video image is then processed by the system 10 in an analogous manner to that described above with regard to the image produced by the video camera 12. The auxiliary video camera 21 is preferably steerable under control of the engine driver, so as to allow the driver to see round curves and also for some considerable distance in front of the bend in the track well before the train arrives at any location imaged by the auxiliary camera. Alternatively, a fiberoptic cable may be laid alongside the track in known manner for directing a laser beam transmitted by an oncoming engine towards a retroreflector disposed diagonally across the tracks such that an obstacle placed on the track ahead of the moving train obstructs the laser beam. The retroreflected laser beam retraces its path along the fiberoptic cable back to the train allowing an on-board processor to determine the presence of the obstacle in sufficient time to enable corrective action to be taken.

Figure 2:
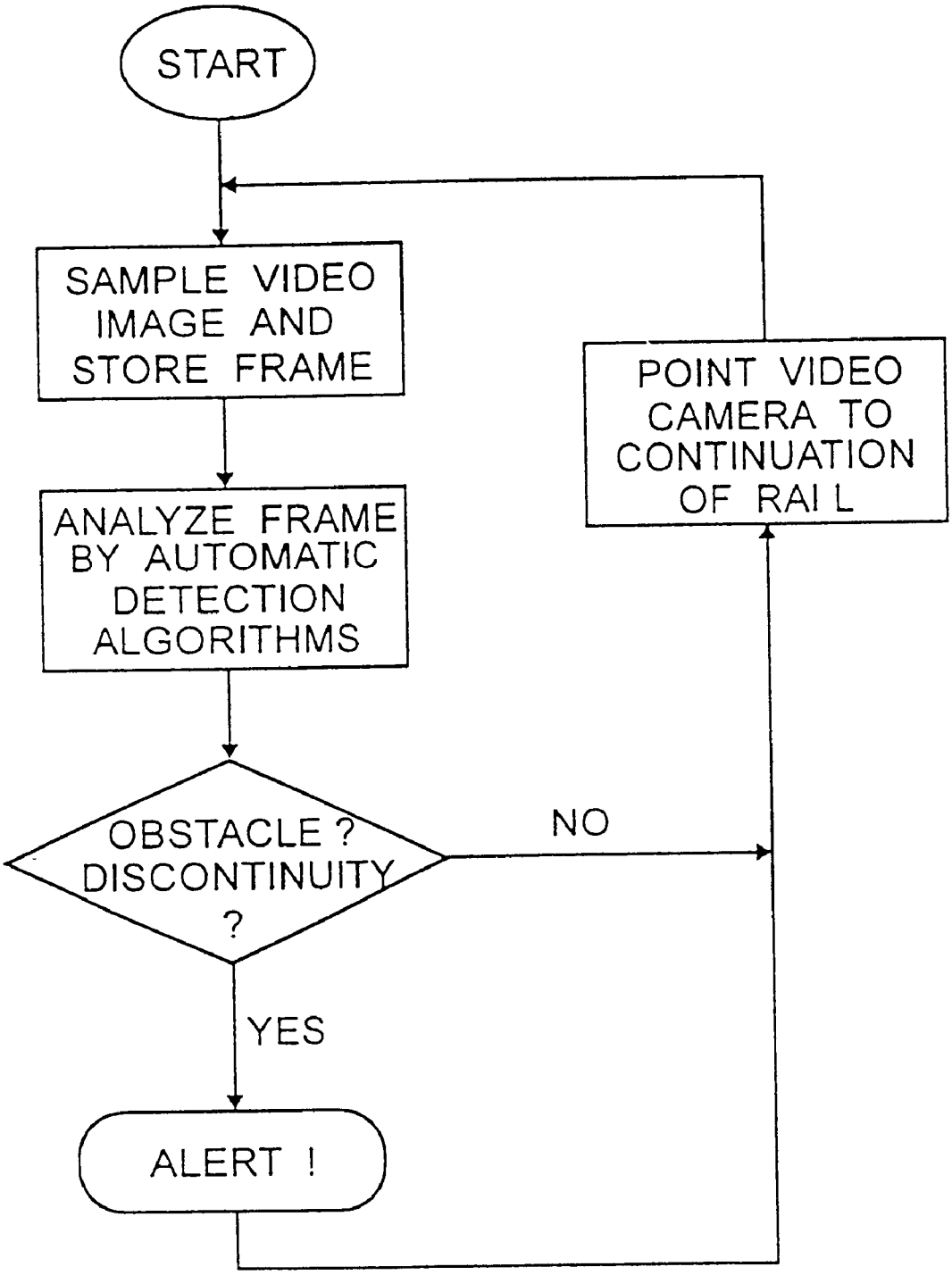
FIG. 2 is a flow diagram showing the principal steps of a method for determining track discontinuity employed by the obstacle detection means in FIG. 1.

FIG. 2 is a flow diagram showing the principal steps of a method employed by the computer 14 for determining track discontinuity so as to detect an apparent obstacle on the track or a break in the track. As noted above, for the purpose of the present invention, a break in the track is as much an impediment to the safe passage of the train as an obstacle placed on the track. Thus, at regular intervals of time, a frame of image data is sampled corresponding to a field of view of the video camera 12 and stored in a memory (not shown) of the computer 14. Each frame of image data, corresponding to a respective state of the rail track, is analyzed by an automatic detection algorithm in order to detect a discontinuity in the rail track indicative of either an obstacle on the track or a broken track. Upon detecting such a discontinuity, the computer 14 produces the obstacle detect signal for warning the engine driver that an obstacle has been detected.

In such a system the engine driver retains the initiative as to whether or not to stop the train, depending on his interpretation of the displayed image of the track.

Figure 3:
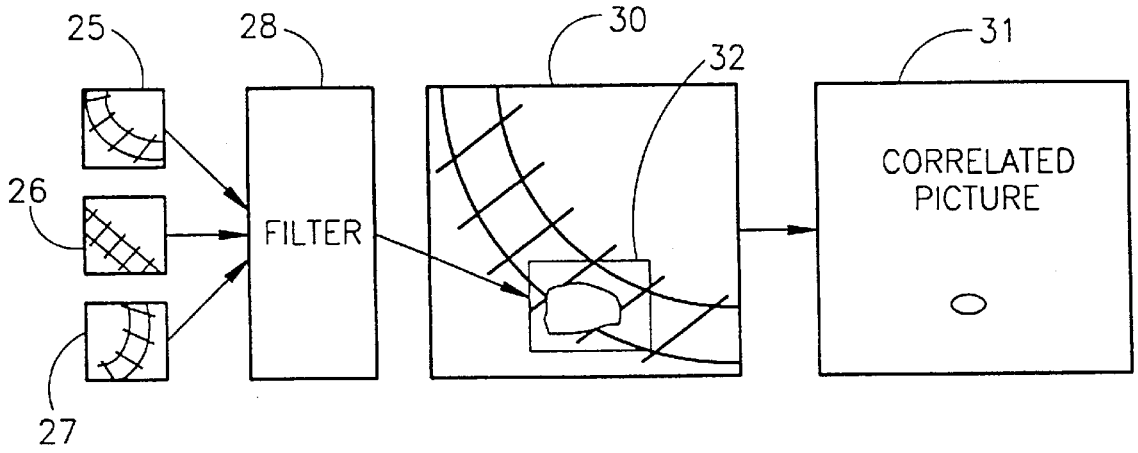
FIG. 3 is a schematic representation of a detail of a first stage of an obstacle detection algorithm based on a library of reference images for identifying the rails in each sensor image.

FIG. 3 shows a first stage of an automatic detection algorithm in accordance with the invention during which the rails are identified in each sensor image. In a subsequent stage shown in FIG. 4, an area around the rails is image processed in order to detect obstacles on the track. Off-line, a library of pre-stored images is created of which only three images 25, 26 and 27 are shown representing different rail configurations at a typical viewing distance of 1 Km and in typical illumination and background conditions. From these images some filters 28 are calculated each being an averaged picture from some typical library images. The filters 28 constitute reference pictures produced by integrating several discrete reference images each containing one or more features having the required principal characteristics. It is simpler to use such filters because they concentrate the characteristic features relating to the track and allow easier distinction between those features characteristic of the background.

A normalized correlation is performed between each video frame 30 and the filter images 28 so as to produce a correlated picture 31. The location of the rails in the picture is determined to be the point where the correlation value is maximal. Having determined the location of the rails in the image 30, a small window 32 is marked around the rails' position. The center of the window 32 contains a rail's segment as seen from a range of 1 Km. The window 32 also contains some area within a range of about 4 m from each side of the rails.

Figure 4:
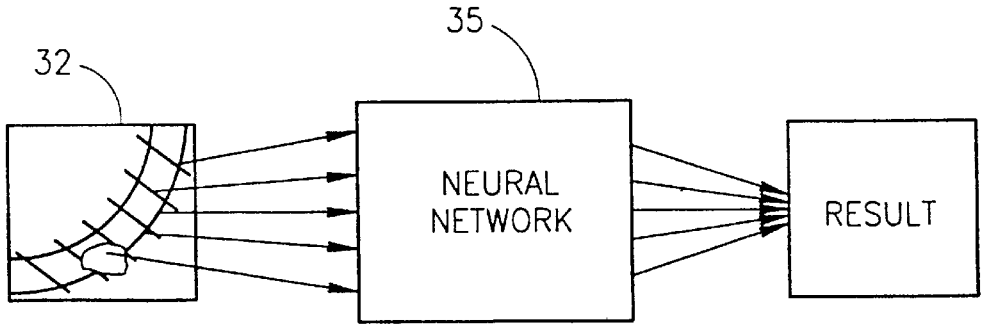
FIG. 4 is a schematic representation of a second stage of the obstacle detection algorithm using neural networks to detect obstacles on the rails.

As shown in FIG. 4, the picture in the window 32 is passed through a neural network 35 which is taught, off-line, to identify obstacles from a pre-prepared set of pictures, including potential obstacles, imaged from a distance of 1 Km and from various angles. This permits a database to be constructed dynamically of potential obstacles and enables records thereof to be added to the database and to be deleted therefrom, as necessary in accordance with possibly changing needs of the system or different applications thereof.

In real time, each image produced by the sensor and contained within the window 32 is analyzed for the existence of potential obstacles as follows. The picture in the window 32 is passed though the neural network 35 so as to provide at an output thereof a decision as to whether or not an obstacle were detected on the rails within the window 32.

It will be apparent that modifications may be made to the invention without departing from the spirit thereof. For example, whilst the invention has been described with particular regard to the use of a video camera for producing an image of the track, it will be apparent that other sensors can be employed instead of, or in addition to, the video camera. Thus, in particular, as noted above, ICCD, FLIR, thermal imaging or Phase Array Radar techniques may also be employed in order to extend visibility of the system.

Also, whilst it is considered preferable to put the decision as to whether to apply the engine's brakes in the hands of the engine driver, there is no technical reason not to couple the engine's brakes directly to the computer 14 so as to apply the engine's brakes automatically responsive to the obstacle detect signal. Such an approach finds particular application in automatic trains having no driver in them. In this case, the obstacle avoidance means applies the brakes automatically in response to an obstacle detect signal.

It is further to be noted that other automatic detection algorithms may also be employed. Likewise, if desired, the camera 12 may be directed to the next sequence of track manually under control of the engine driver.

In order to produce a stable image, regardless of the train's motion, the video camera 12 is preferably damped so that any inherent vibration thereof is minimized.

It will also be appreciated that any number of posts or towers may be provided each having a respective auxiliary video camera for transmitting to the engine, or to a stationary control center, a respective auxiliary image of a region of track within its field of view.

The invention is equally adapted to detect personnel on the tracks. For example, personnel may carry on their person a receiver/alarm for receiving a warning signal transmitted by the obstacle detection system. On receiving such a warning signal, they know of an approaching train possibly even before it is within their line of sight (particularly if the train approaches the personnel from behind a curve).

The same concept allows for detection of people on a grade (or level) crossing so as to warn them well in advance of an approaching train where it is known from empirical data that a large proportion of train accidents take place. Thus, for all weather detection at grade crossings, a small radar is mounted in conjunction with the video camera 12. Within the locomotive, a database is maintained of the location of each grade crossing allowing the radar to be pointed to each grade crossing in the approach path of an oncoming train.

At opposite ends of each grade crossing, some of the adjacent sleepers are replaced by sleepers which are modified to reflect an echo having characteristics easily identified by the radar. When pointed towards the grade crossing, the radar is thus able automatically to detect the modified sleepers both before and after the grade crossing unless, of course, an obstacle or person on the grade crossing interrupts the radar. In this case, one of the characteristic echo signals will not be received by the radar and the presence of an obstacle on the grade crossing may thereby be inferred.

A Global Positioning System (GPS) may be mounted on the engine and coupled to a database of the coordinates of grade crossings along the track so as to allow for automatic positioning of the video camera 12 or other sensor from side to side of the grade crossing. Likewise, the database may store therein the coordinates of buildings and the like alongside the track so that such buildings will not be mistakenly interpreted as obstacles thereby reducing the incidence of false alarms.

The invention also contemplates a system for automatically guiding a free-running vehicle, such as a tram, along a path defined by a visible (or otherwise detectable) line. For example, in a dockyard a visible line might be painted where motion of vehicles may be permitted, so as to allow detection of the visible line and thereby permit automatic guidance of the vehicle along the line. This approach obviates the need for rails to be provided as is currently done, thus saving installation and maintenance costs.

What is claimed is:

1. A system for alerting a controller of a track-led vehicle of the presence of an obstacle in a track of said vehicle, the system comprising:

at least one sensor mounted on the vehicle for sensing a field of view of the track in front of the vehicle so as to produce successive sensor signals each representative of a respective successive section of track ahead of the vehicle, an obstacle detection device coupled to the sensor means for processing said successive sensor signals so as to detect therefrom a discontinuity in the track and to produce an obstacle detect signal consequent thereto, an obstacle avoidance device mounted in the vehicle and coupled to the obstacle detection device and being responsive to the obstacle detect signal for producing an obstacle avoidance signal, and a memory containing pre-stored obstacle data indicative of recognizable obstacle characteristics;

the obstacle detection device being coupled to the memory for comparing the at least one sensor signal with the pre-stored obstacle data so as to produce the obstacle detect signal consequent to a match.

2. The system according to claim 1, wherein the at least one sensor includes a video camera having means for automatically directing the video camera towards the track for producing a video image thereof, and the obstacle detection device is coupled to the video camera for processing the video image produced thereby so as to detect said discontinuity in the video image of the track indicative of an obstacle on the track;

there being further included a video monitor coupled to the video camera for displaying said video image.

3. The system according to claim 2, wherein the video camera is mounted on gimbals.

4. The system according to claim 2, wherein the video camera is a day/night video camera.

5. The system according to claim 2, wherein there are coupled to the video monitor a control means for controlling at least one feature of the displayed video image.

6. The system according to claim 2, further including a video recorder coupled to the video monitor for recording the video image.

7. The system according to claim 2, further including:

a receiver coupled to the obstacle detection means for receiving at least one auxiliary video image of a section of the vehicle's track outside of the field of view of said video camera, and at least one post or tower having mounted thereon a respective auxiliary video camera for imaging a region of said track within its field of view and producing a corresponding auxiliary video image, and a transmitter coupled to the auxiliary video camera for transmitting the auxiliary video image to the receiver.

8. The system according to claim 7, wherein the auxiliary video camera is a day/night video camera.

9. The system according to claim 1, wherein:

the controller is a driver of the vehicle, and the obstacle avoidance device includes an alarm for warning the driver of a possible impending collision.

10. The system according to claim 1, wherein:

the controller is a driver of the vehicle, and the obstacle avoidance device includes an automatic brake for automatically operating brakes in the vehicle.

11. The system according to claim 10, wherein:

the at least one sensor signal is transmitted to, and processed by a monitoring and control center in real time in order to decide whether or not to apply the brakes, and the monitoring and control center includes means for relaying a brake control signal to the vehicle for automatically operating said brakes.

12. The system according to claim 1, wherein:

the vehicle is automatically controlled by said controller, and the obstacle avoidance device includes an automatic brake for automatically operating brakes in the vehicle.

13. The system according to claim 12, wherein:

the at least one sensor signal is transmitted to, and processed by a monitoring and control center in real time in order to decide whether or not to apply the brakes, and the monitoring and control center includes means for relaying a brake control signal to the vehicle for automatically operating said brakes.

14. The system according to claim 1, wherein the at least one sensor includes a radar in addition to an electro-optical imaging system for improving the detection of obstacles in adverse weather conditions.

15. The system according to claim 14, further including reflectors placed between or alongside the rails for detection by the radar so that an obstacle hides the reflectors from the radar thus preventing their detection.

16. The system according to claim 1, wherein the vehicle is a railway engine and the track is a rail track.

17. The system according to claim 16, wherein the at least one sensor includes an imaging device mounted on the engine and automatically directed towards the track for producing an image thereof, and the obstacle detection device is coupled to the imaging device for processing the image produced thereby so as to detect a discontinuity in the image of the track and produce the obstacle detect signal consequent thereto;

there being further included a display monitor coupled to the imaging device for displaying said video image.

18. The system according to claim 17, further including:

a database for storing therein coordinates of background objects in a region of the track, a Global Positioning System (GPS) mounted in the engine for determining a location in 3-dimensional space thereof, and directing means coupled to the imaging means and to the Global Positioning System for directing the imaging means towards the track so as to image an area thereof having a known location in 3-dimensional space;

the obstacle detection means being responsively coupled to the database for extracting from the database the coordinates of background objects in a region of the imaged area so as to eliminate said background objects as potential obstacles thereby reducing false alarms.

19. The system according to claim 17, wherein the obstacle detection device includes:

a database construction unit for preparing a set of pictures, including potential obstacles, imaged from a specified distance and from various angles so as to construct dynamically a database of potential obstacles, a locating unit for locating a rail in said image, and a comparator for comparing a segment of said image within an area of the rail with at least some of the pictures in said database so as to determine whether said area of the image corresponds to an obstacle on the rail.

20. The system according to claim 19, wherein the comparator is a neural network for providing at an output thereof a decision as to whether or not an obstacle were detected on the rails within said area.

21. The system according to claim 17, wherein:

the obstacle detection device is adapted to identify personnel on the track for producing the obstacle detection signal, and there is further provided:

a transmitter coupled to the obstacle detection device and responsive to the obstacle detection signal for transmitting a warning signal to a receiver/alarm unit carried by the personnel so as to warn the personnel of an approaching train.

22. The system according to claim 1, for automatically guiding a vehicle along a track defined by a visible or otherwise detectable line on a road surface.

23. A system for alerting a controller of a track-led vehicle of the presence of an obstacle in a track of said vehicle, the system comprising:

at least one sensor including a video camera mounted on the vehicle for sensing a field of view of the track in front of the vehicle so as to produce successive video images thereof each representative of a respective successive section of track ahead of the vehicle, an obstacle detection device coupled to the video camera for processing successive video images produced thereby so as to detect therefrom a discontinuity in the video image of the track indicative of an obstacle on the track and to produce an obstacle detect signal consequent thereto, an obstacle avoidance device mounted in the vehicle and coupled to the obstacle detection device and being responsive to the obstacle detect signal for producing an obstacle avoidance signal, a video monitor coupled to the video camera for displaying said video image, and a directing unit coupled to the video camera for automatically directing the video camera towards the track, said directing unit comprising:

an apparent movement device for determining apparent movement of the track between successive frames of video image data each corresponding to a respective section of the track, and an adjusting device coupled to the apparent movement device and to the video camera for automatically adjusting the orientation of the video camera in order to compensate for said apparent movement.

24. The system according to claim 23, wherein the apparent movement device comprises:

a comparator for comparing said successive frames of video data so as to determine those areas which are common to a preceding and subsequent frame, a derivation device coupled to the comparator for deriving that part of the subsequent frame corresponding to the continuation of the track from the preceding frame so as to identify the point in the preceding frame where the subsequent frame commences, and a computer coupled to the derivation device for computing the direction of a far end of the track in the subsequent frame relative to a start thereof so as thereby to derive the continuation of the subsequent frame;

the adjusting device being responsive to the computer for cyclically directing the video camera to the start of the subsequent frame, corresponding to the end of the preceding frame.

25. The system according to claim 23, further including:

a receiver coupled to the obstacle detection means for receiving at least one auxiliary video image of a section of the vehicle's track outside of the field of view of said video camera, and at least one post or tower having mounted thereon a respective auxiliary video camera for imaging a region of said track within its field of view and producing a corresponding auxiliary video image, and a transmitter coupled to the auxiliary video camera for transmitting the auxiliary video image to the receiver.

26. The system according to claim 25, further including a steering unit coupled to the auxiliary video camera for operating under control of the controller so as vary the field of view of the auxiliary video camera.

27. The system according to claim 25, wherein the auxiliary video camera is a day/night video camera.

28. The system according to claim 23, wherein the video camera is a day/night video camera.

29. The system according to claim 23, wherein:

the controller is a driver of the vehicle, and the obstacle avoidance device includes an alarm for warning the driver of a possible impending collision.

30. The system according to claim 23, wherein:

the controller is a driver of the vehicle, and the obstacle avoidance device includes an automatic brake for automatically operating brakes in the vehicle.

31. The system according to claim 30, wherein:

the at least one sensor signal is transmitted to, and processed by a monitoring and control center in real time in order to decide whether or not to apply the brakes, and the monitoring and control center includes means for relaying a brake control signal to the vehicle for automatically operating said brakes.

32. The system according to claim 23, wherein:

the vehicle is automatically controlled by said controller, and the obstacle avoidance device includes an automatic brake for automatically operating brakes in the vehicle.

33. The system according to claim 32, wherein:

the at least one sensor signal is transmitted to, and processed by a monitoring and control center in real time in order to decide whether or not to apply the brakes, and the monitoring and control center includes means for relaying a brake control signal to the vehicle for automatically operating said brakes.

34. The system according to claim 23, wherein the at least one sensor includes a radar in addition to an electro-optical imaging system for improving the detection of obstacles in adverse weather conditions.

35. The system according to claim 34, further including reflectors placed between or alongside the rails for detection by the radar so that an obstacle hides the reflectors from the radar thus preventing their detection.

36. The system according to claim 23, wherein the vehicle is a railway engine and the track is a rail track.

37. The system according to claim 36, wherein the at least one sensor includes an imaging device mounted on the engine and automatically directed towards the track for producing an image thereof, and the obstacle detection device is coupled to the imaging device for processing the image produced thereby so as to detect a discontinuity in the image of the track and produce the obstacle detect signal consequent thereto;

there being further included a display monitor coupled to the imaging device for displaying said video image.

38. The system according to claim 37, further including:

a database for storing therein coordinates of background objects in a region of the track, a Global Positioning System (GPS) mounted in the engine for determining a location in 3-dimensional space thereof, and directing means coupled to the imaging means and to the Global Positioning System for directing the imaging means towards the track so as to image an area thereof having a known location in 3-dimensional space;

the obstacle detection means being responsively coupled to the database for extracting from the database the coordinates of background objects in a region of the imaged area so as to eliminate said background objects as potential obstacles thereby reducing false alarms.

39. The system according to claim 37, wherein the obstacle detection device includes:

a database construction unit for preparing a set of pictures, including potential obstacles, imaged from a specified distance and from various angles so as to construct dynamically a database of potential obstacles, a locating unit for locating a rail in said image, and a comparator for comparing a segment of said image within an area of the rail with at least some of the pictures in said database so as to determine whether said area of the image corresponds to an obstacle on the rail.

40. The system according to claim 39, wherein the comparator is a neural network for providing at an output thereof a decision as to whether or not an obstacle were detected on the rails within said area.

41. The system according to claim 37, wherein:

the obstacle detection device is adapted to identify personnel on the track for producing the obstacle detection signal, and there is further provided:

a transmitter coupled to the obstacle detection device and responsive to the obstacle detection signal for transmitting a warning signal to a receiver/alarm unit carried by the personnel so as to warn the personnel of an approaching train.

42. The system according to claim 23, for automatically guiding a vehicle along a track defined by a visible or otherwise detectable line on a road surface.

43. A system for alerting a controller of a track-led vehicle of the presence of an obstacle in a track of said vehicle, the system comprising:

at least one sensor including a video camera mounted on the vehicle for sensing a field of view of the track in front of the vehicle so as to produce successive video images thereof each representative of a respective successive section of track ahead of the vehicle, an obstacle detection device coupled to the video camera for processing successive video images produced thereby so as to detect therefrom a discontinuity in the video image of the track indicative of an obstacle on the track and to produce an obstacle detect signal consequent thereto, an obstacle avoidance device mounted in the vehicle and coupled to the obstacle detection device and being responsive to the obstacle detect signal for producing an obstacle avoidance signal, a video monitor coupled to the video camera for displaying said video image, and a directing unit coupled to the video camera for automatically directing the day/night video camera towards the track, a receiver coupled to the obstacle detection unit for receiving at least one auxiliary video image of a section of the vehicle's track outside of the field of view of said day/night video camera, at least one post or tower having mounted thereon a respective auxiliary video camera for imaging a region of said track within its field of view and producing a corresponding auxiliary video image, a transmitter coupled to the auxiliary video camera for transmitting the auxiliary video image to the receiver, and a steering unit coupled to the auxiliary video camera for operating under control of the controller so as vary the field of view of the auxiliary video camera.

44. The system according to claim 43, wherein at least one of the video camera and the auxiliary video camera is a day/night video camera.

45. The system according to claim 43, further including:

a memory containing pre-stored obstacle data indicative of recognizable obstacle characteristics;

the obstacle detection device being coupled to the memory for comparing the at least one sensor signal with the pre-stored obstacle data so as to produce the obstacle detect signal consequent to a match.

46. The system according to claim 43, wherein the directing unit comprises:

an apparent movement device for determining apparent movement of the track between successive frames of video image data each corresponding to a respective section of the track, and an adjusting device coupled to the apparent movement device and to the video camera for automatically adjusting the orientation of the video camera in order to compensate for said apparent movement.

47. A system for alerting a controller of a railway engine of the presence of an obstacle on a railway track thereof, the system comprising:

at least one sensor including a video camera mounted on the railway engine for sensing a field of view of the railway track in front of the railway engine so as to produce successive video images thereof each representative of a respective successive section of railway track ahead of the railway engine, an obstacle detection device coupled to the video camera for processing successive video images produced thereby so as to detect therefrom a discontinuity in the video image of the railway track indicative of an obstacle on the railway track and to produce an obstacle detect signal consequent thereto, an obstacle avoidance device mounted in the railway engine and coupled to the obstacle detection device and being responsive to the obstacle detect signal for producing an obstacle avoidance signal, a video monitor coupled to the video camera for displaying said video image, a directing unit coupled to the video camera for automatically directing the video camera towards the track, a database construction unit for preparing a set of pictures, including potential obstacles, imaged from a specified distance and from various angles so as to construct dynamically a database of potential obstacles, a locating unit for locating a rail in said image, and a comparator for comparing a segment of said image within an area of the rail with at least some of the pictures in said database so as to determine whether said area of the image corresponds to an obstacle on the rail.

48. The system according to claim 47, wherein the at least one sensor includes an imaging device mounted on the engine and automatically directed towards the track for producing an image thereof, and the obstacle detection device is coupled to the imaging device for processing the image produced thereby so as to detect a discontinuity in the image of the track and produce the obstacle detect signal consequent thereto;

there being further included a display monitor coupled to the imaging device for displaying said video image.

49. The system according to claim 48, further including:

a database for storing therein coordinates of background objects in a region of the track, a Global Positioning System (GPS) mounted in the engine for determining a location in 3-dimensional space thereof, and directing means coupled to the imaging means and to the Global Positioning System for directing the imaging means towards the track so as to image an area thereof having a known location in 3-dimensional space;

the obstacle detection means being responsively coupled to the database for extracting from the database the coordinates of background objects in a region of the imaged area so as to eliminate said background objects as potential obstacles thereby reducing false alarms.

50. The system according to claim 48, wherein:

the obstacle detection device is adapted to identify personnel on the track for producing the obstacle detection signal, and there is further provided:

a transmitter coupled to the obstacle detection device and responsive to the obstacle detection signal for transmitting a warning signal to a receiver/alarm unit carried by the personnel so as to warn the personnel of an approaching train.

51. The system according to claim 47, further including:

a memory containing pre-stored obstacle data indicative of recognizable obstacle characteristics;

the obstacle detection device being coupled to the memory for comparing the at least one sensor signal with the pre-stored obstacle data so as to produce the obstacle detect signal consequent to a match.

52. The system according to claim 47, wherein the comparator is a neural network for providing at an output thereof a decision as to whether or not an obstacle were detected on the rails within said area.

53. A method for alerting a controller of a track-led vehicle of the presence of an obstacle in a track of said vehicle comprising at least one rail, the method comprising the steps of:

(1) automatically directing a video camera towards the track for producing successive frames of video image data each representative of a successive section of track ahead of the vehicle, by:

a) determining apparent movement of the at least one rail of the track between successive frames of video image data each corresponding to a respective section of the track, and b) automatically adjusting the orientation of the video camera in order to compensate for said apparent movement, (2) processing said successive video images so as to detect therefrom a discontinuity in the at least one rail of said track, and (3) producing an obstacle detect signal consequent thereto.

54. The method according to claim 53, wherein the step of determining apparent movement of the track comprises:

(1) comparing said successive frames of video data so as to determine those areas which are common to a preceding and subsequent frame, (2) deriving that part of the subsequent frame corresponding to the continuation of the track from the preceding frame so as to identify the point in the preceding frame where the subsequent frame commences, and (3) computing the direction of a far end of the track in the subsequent frame relative to a start thereof so as thereby to derive the continuation of the subsequent frame.

55. The method according to claim 53, further including the steps of:

(4) determining the position of each rail in the section of track, (5) defining around the track's position a window containing a segment of each rail of the section of track as seen from a pre-determined range, and (6) passing each image produced by the sensor and contained within the window though a neural network so as to provide at an output thereof a decision as to whether or not an obstacle were detected on the section of track within the window.

56. The method according to claim 55, wherein the step of determining the position of each rail in the section of track includes:

a) obtaining successive frames each containing respective segments of track at successive instants of time, and b) comparing each frame with a subsequent frame in order to determine those areas which are common to both frames thereby deriving that part of the subsequent frame corresponding to a continuation of the rail from the preceding frame.

* * * * *